United States Patent [19]

Hinata et al.

[11] 3,953,216

[45] Apr. 27, 1976

[54] SPECTRALLY SENSITIZED SILVER HALIDE PHOTOGRAPHIC EMULSION

[75] Inventors: Masanao Hinata; Haruo Takei; Akira Sato; Akira Ogawa, all of Minami-ashigara, Japan

[73] Assignee: Fuji Photo Film Co., Ltd., Minami-ashigara, Japan

[22] Filed: Aug. 16, 1974

[21] Appl. No.: 498,143

[30] Foreign Application Priority Data

Aug. 16, 1973 Japan ..... 48-91896

[52] U.S. Cl. ..... 96/126

[51] Int. Cl.[2] ..... G03C 1/14

[58] Field of Search ..... 96/126

[56] References Cited

UNITED STATES PATENTS

| | | | |
|---|---|---|---|
| 2,977,229 | 3/1961 | Jones | 96/126 |
| 3,671,260 | 6/1972 | Oftedahl et al. | 96/126 |
| 3,822,136 | 7/1974 | Sakazume et al. | 96/126 |

*Primary Examiner*—J. Travis Brown

*Attorney, Agent, or Firm*—Sughrue, Rothwell, Mion, Zinn & Macpeak

[57] ABSTRACT

A spectral-sensitized silver halide photographic emulsion containing in supersensitizing amounts the combination of 1. at least one sensitizing dye represented by the formula (I)

wherein $Z_1$ and $Z_2$ are the atomic groups necessary for forming a benzoxazole ring or a napthoxazole ring, in which a benzene nucleus of the ring may be substituted; $R_1$ and $R_2$ are aliphatic groups and at least one of $R_1$ or $R_2$ is a carboxyalkyl group or a sulfoalkyl group; $R_3$ is a hydrogen atom or an alkyl group; X is an acid anion group; and m is 1 or 2 and m is 1 when the dye forms an intramolecular salt having a betaine like-structure, 2. at least one sensitizing dye represented by the formula (II)

(II)

wherein $Z_3$ is an atomic group necessary for forming a 5-membered or 6-membered heterocyclic ring which may be substituted by substituents other than $R_4$; $Z_4$ is an atomic group necessary for forming a 2-pyrazoline-5-one ring nucleus which may be substituted; $R_4$ is an aliphatic group; $R_5$ is a hydrogen atom, an alkyl group, or an aryl group; and *n* is 1 or 2.

7 Claims, 5 Drawing Figures

SPECTRALLY SENSITIZED SILVER HALIDE PHOTOGRAPHIC EMULSION

BACKGROUND OF THE INVENTION

1. Field of the Invention

The present invention relates to a silver halide photographic emulsion which is spectrally sensitized with at least two sensitizing dyes having a super-sensitizing action. More particularly, the present invention relates to a silver halide photographic emulsion in which the spectral sensitivity of the silver halide in the green color wavelength region of the spectrum is increased.

2. Description of the Prior Art

It is well known to extend the photosensitive wavelength region of a silver halide photographic emulsion into a longer wavelength region by addition certain cyanine dyes thereto, i.e., spectral sensitization is used as one method of producig a photographic photosensitive material.

The spectral sensitivity is usually influenced by the chemical structure of the sensitizing dye and the properties of the emulsion such as the halogen composition, the crystal habit, the crystal system, the silver ion concentration, the hydrogen ion concentration and the like of the silver halide. Moreover, the spectral sensitivity is influenced by the sensitizer, the antifogging agent, the auxiliary coating agent, the precipitating agent, the color coupler, and the like which are generally present in the emulsion.

In general, a single sensitizing dye is used for sensitization of a given spectral wavelength region of a photosensitive material. Where such spectral-sensitizing dyes are used in admixture with each other, the spectral sensitivity produced is often lower than that produced by the sensitizing dyes individually. In some specific cases, however, the spectral sensitivity is superadditively increased by using a certain sensitizing dye in combination with at least one other sensitizing dye. This phenomenon is known as "supersensitization". A considerable selectivity is required in combining such sensitizing dyes and since the supesensitization is markedly influenced by a slight difference in the chemical structures of the sensitizig dyes used, it is difficult to predict a combination of sensitizing dyes exhibiting supersensitization only from the chemical structures of the sensitizing dyes.

The sensitivity produced by a certain dye is usually influenced by the type of the emulsion to which the dye is added, and particularly, the halogen composition, the crystal habit, the crystal system, and the like of the silver halide.

Moreover, the sensitivity of a given emulsion can be changed by changing the state of the emulsion. For instance, the sensitivity can be increased by increasing the silver ion concentration, or decreasing the hydrogen ion concentration, or effecting these changes simultaneously. Thus, the sensitivity can be increased by immersing a film with a spectral-sensitized emulsion coated thereon in water or an aqueous ammonium solution. The above described methods wherein the sensitivity of a sensitized emulsion is changed by increasing the silver ion concentration, or decreasing the hydrogen ion concentration, or effecting these changes simultaneously, are generally called hypersensitization. A hypersensitized emulsion generally has a short storage life.

The requirements for the sensitizing dye used in applying the supersensitization to the silver halide photographic emulsion are: the sensitizing dye does not adversely interact with photograhic additives other than the sensitizing dye, and the sensitizing dye possesses stable photographic characteristics during the storage of the photosensitive material.

Another requirement for the sensitizing dye is that no residual coloring due to the sensitizing dye remains in the photosensitive material after processing. It is particularly required that the sensitizing dye leaves no residual coloring on processing in a short time, generally several seconds to several ten seconds, such as in rapid processing.

At the present time, for spectral sensitization in the green color wavelength region, oxacarbocyanine based dyes, imidacarbocyanine based dyes, 2,2'-thiacyanine(pseudo) based dyes, and dimethinemerocyanine based dyes are used, alone or in admixture with each other. The silver halide emulsion spectral-sensitized with these sensitizing dyes is applicable to a green photosensitive layer for color photography, a lith type orthochromatic photosensitive material for plate making, an indirect X-ray photographic material wherein an X-ray image is projected on a fluorescent plate and photographed, and a photosensitive material for use in a cathode ray tube display system.

In the green sensitive layer, it is preferred that the longer wavelength part overlap the shorter wavelength part of the red sensitive layer less because less overlap reduces color mixing.

In the litho type film and the indirect X-ray film, it is desired that the processing including the development and fixing be carried out in a well-lighted room. These photosensitive members are processed under a safe light as passed through a No. 6 or No. 7 Safe Light Filter produced by Fuji Photo Film Co., Ltd., or under a similar safe light. To increase the safe light stability, it is advantageous that the longer wavelength part of the spectral sensitivity be shifted to as short a wavelength side as is possible.

Thus, spectral sensitization in which the photosensitive longer wavelength part is present at a relatively shorter wavelength and which can provide high green sensitivity, has been desired.

SUMMARY OF THE INVENTION

An object of the present invention is to provide a spectrally sensitized silver halide photographic emulsion which has high sensitivity in the green wavelength region and which causes less residual coloring.

Another object of the present invention is to provide a silver halide photographic emulsion suitable for producing a color photosensitive material in which the photosensitive longer wavelength part is present at a relatively shorter wavelength, in which the green sensitivity is high, and in which the residual coloring is small.

Still another object of the present invention is to provide a silver halide photographic emulsion suitable for producing a medical X-ray photographic material which has high sensitivity to the emission of a green fluorescent body and has high stability to a safe light.

A further object of the present invention is to provide a silver halide photographic emulsion having a spectral sensitivity which causes less high illumination (short time exposure) disorder and which is suitable for recording of a cathode ray tube display system.

Another object of the present invention is to provide a silver halide photographic emulsion wherein the reduction of sensitivity which has been caused by the use of a combination of a dye and a magenta coupler is reduced.

A still further object of the present invention is to provide a silver halide photographic emulsion containing a combination of sensitizing dyes which provides a photographic material in which the reduction of sensitivity with the passage time is decreased.

It has been found that the above described objects can be attained with a silver halide photographic emulsion containing in supersensitizing amounts 1. at least one sensitizing dye represented by the formula (I)

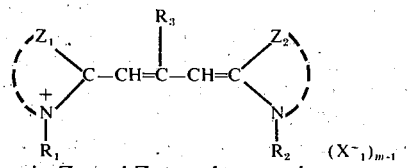

(I)

wherein $Z_1$ and $Z_2$ are the atomic groups necessary for forming a benzoxazole ring or a naphthoxazole ring in which a benzene nucleus may be substituted; $R_1$ and $R_2$ are aliphatic groups, and at least one of $R_1$ or $R_2$ is a carboxyalkyl group or a sulfoalkyl group; $R_3$ is a hydrogen atom or an alkyl group; X is an acid anion; and m is 1 or 2 and m is 1 when the dye forms an intramolecular betaine type salt, and 2. at least one sensitizing dye represented by the formula (II)

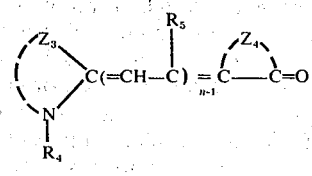

(II)

wherein $Z_3$ is an atomic group necessary for forming a 5-membered or 6-membered heterocyclic ring in which the ring may be substituted by substituents other than $R_4$; $Z_4$ is an atomic group required for forming a 2-pyrazoline-5-one ring nucleus in which the nucleus may be substituted; $R_4$ is an aliphatic group; $R_5$ is a hydrogen atom, an alkyl group, or an aryl group; and n is 1 or 2. This discovery is astonishing because the spectral sensitivity produced by the sensitizing dye represented by the formula (I) alone is quite low.

DETAILED DESCRIPTION OF THE INVENTION

Figure 1:
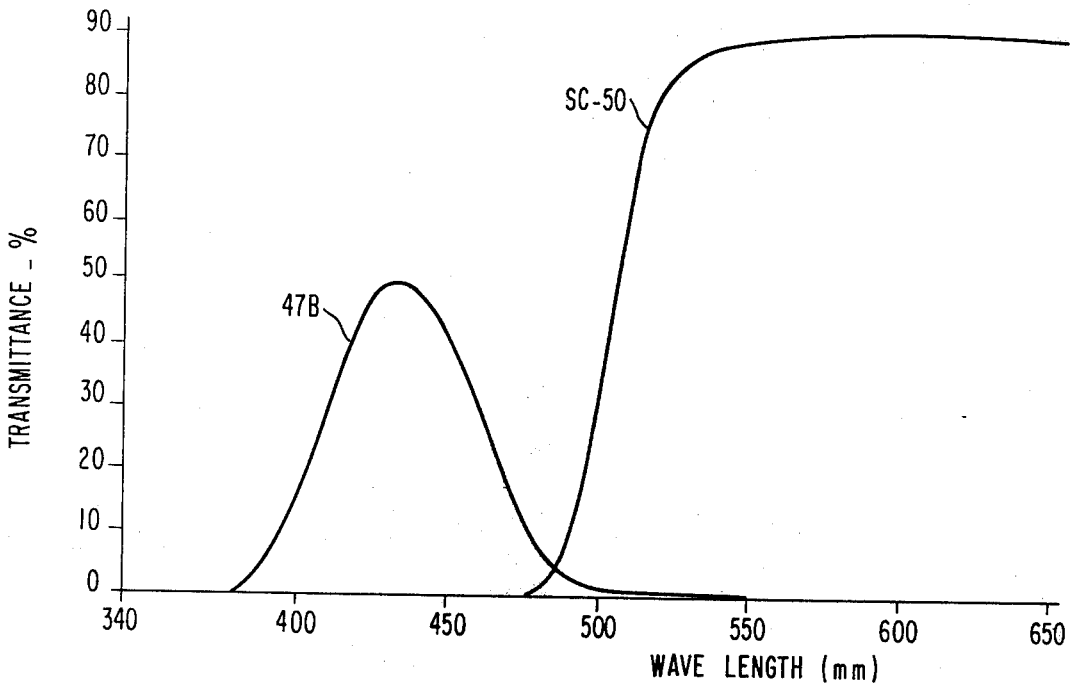
FIG. 1 shows the spectral transmission curves of Wratten Filter 47B, produced by Eastman Kodak, and SC-50, produced by Fuji Photo Film Co., Ltd.

In the formulae (I) and (II) of the sensitizing dyes as used in the present invention, the heterocyclic rings formed by $Z_1$ and $Z_2$, which can be substituted with one or more of a halogen atom such as fluorine, chlorine and bromine, a trifluoromethyl group, an alkyl group containing preferably 1 to 4 carbon atoms such as a methyl group, an ethyl group, etc., a monoaryl group such as a phenyl group, a p-sulfophenyl group, etc., a carboxy group, a carboxyalkyl group having an alkyl moiety containing preferably 1 to 4 carbon atoms such as a carboxymethyl group, a carboxyethyl group, etc., and the like, include a benzoxazole ring, a 5-fluorobenzoxazole ring, a 5-chlorobenzoxazole ring, a 5-bromobenzoxazole ring, a 5-trifluoromethylbenzoxazole ring, a 5-methylbenxozazole ring, a 5,6-dimethyl benzoxazole ring, a methoxybenzoxazole ring, a 5,6-dimethylbenzoxazole ring, a 5-phenylbenzoxazole ring, a 5-carboxybenzoxazole ring, a 5-carboxymethylbenzoxazole ring, a $\beta$-naphthoxazole ring, and the like.

Heterocyclic rings formed by $Z_3$ include a pyridine ring, a quinoline ring, an oxazoline ring, an oxazole ring, a thiazoline ring, a thiazole ring, a selenazole ring, a benzoxazole ring, a benzothiazole ring, a benzoselenazole ring, a benzimidazole ring, a dialkylindolenine ring, a $\alpha$-naphthoxazole ring, a $\beta$-naphthoxazole ring, a $\beta,\beta$-naphthoxazole ring, a $\alpha$-naphthothiazole ring, a $\beta$-naphthothiazole ring, a $\beta,\beta$-naphthothiazole ring, a $\alpha$-naphthoselenazole ring, a tetrazole ring, a pyrroline ring, and the like. These rings may be substituted with one or more of a halogen atom, alkyl group, alkoxy group, alkoxycarbonyl group, and aryl group as described for $Z_1$ and $Z_2$.

The pyrazoline-5 -one ring formed by $Z_4$ can be substituted with one or more of an alkyl group preferably containing 1 to 4 carbon atoms such as methyl, ethyl, propyl, and the like; an alkoxy group preferably containing 1 to 4 carbon atoms such as a methoxy group and an ethoxy group; an alkoxycarbonyl group in which the alkyl moiety preferably has 1 to 4 carbon atoms, such as a methoxycarbonyl group, an ethoxycarbonyl group, and the like; an aryl group such as a phenyl group and a substituted aryl group, e.g., a sulfophenyl group, a carboxyphenyl group, a trichlorophenyl group, and the like; an alkoxyalkyl group in which the alkyl moiety preferably has 1 to 4 carbon atoms, such as a substituted alkoxyalkyl group, e.g., a hydroxymethoxyethyl group, a 2-hydroxyethoxymethyl group, a 2-(2-hydroxyethoxy)ethyl group, a 2-(2-acetoxyethoxy)ethyl group, an acetoxymethoxymethyl group, and the like; an N-(N,N-dialkylaminoalkyl)carbamoylalkyl group in which the alkyl moiety has preferably 1 to 4 carbon atoms, such as an N-[3-(N,N-dimethylamino)-propyl]carbamoylmethyl group, an N-[2-(N,N-diethylamino)ethyl]carbamoylmethyl group, an N-[3-(morpholino)propyl]carbamoylmethyl group, an N-[3-(piperidino)propyl]carbamoylmethyl group, and the like; an N-[N,N,N-trialkylammoniumalkyl)carbamoylalkyl group in which the alkyl moiety preferably has 1 to 4 carbon atoms, such as an N-[3-(N,N,N-trimethylammonium)propyl]carbamoylmethyl group, an N-[3-(N,N,N-triethylammonium)propyl]carbamoylmethyl group, an N-[3-(N-methylmorpholinolium)-propyl]carbamoylmethyl group, an N-[3-(N-methylpiperidinonium)propyl]carbamoylmethyl group, and the like; an N,N,N-trialkylammoniumalkyl group in which the alkyl moiety preferably has 1 to 4 carbon atoms, such as an N,N-diethyl-N-methylammoniumethyl group, an N,N,N-triethylammoniumethyl group, and the like; an allyl group such as a vinylmethyl group; a hydroxyalkyl group in which the alkyl moiety preferably has 1 to 4 carbon atoms, such as a hydroxymethyl group, a β-hydroxyethyl group, and the like; a carboxyalkyl group such as carboxymethyl group, a carboxyethyl group, and the like; a sulfoalkyl group such as a sulfoethyl group, a sulfopropyl group, and the like; and an amino group, etc.

The aliphatic groups represented by $R_1$, $R_2$, and $R_4$ include a unsubstituted alkyl group preferably containing 1 to 8 carbon atoms, such as a methyl group, an ethyl group, a propyl group, and the like; and a substituted alkyl group in which the alkyl moiety preferably has 1 to 4 carbon atoms and having as substituents a hydroxy group, a carboxy group, a sulfo group, and the like, such as a 2-hydroxyethyl group, a 3-hydroxypropyl group, a 2-carboxyethyl group, a 3-carboxypropyl group, a 4-carboxybutyl group, a 2-sulfoethyl group, a 3-sulfopropyl group, a 3-sulfobutyl group, a 4-sulfobutyl group, a 2-hydroxy-3-sulfopropyl group, a 3-sulfopropoxyethoxyethyl group, and the like; etc.

The alkyl groups represented by $R_3$ and $R_5$ are the same unsubstituted alkyl groups as in $R_1$, $R_2$, and $R_4$.

The aryl group represented by $R_5$ includes a phenyl group, a carboxyphenyl group, and the like.

$X^-$ represents a mineral acid ion, such as an iodine ion, a bromine ion, a chlorine ion, a perchlorate ion, a thiocyanate ion, and the like; and an organic acid ion, such as p-benzene-sulfonic acid ion, a benzenesulfonic acid ion, an ethyl sulfate ion, and the like.

The oxacarbocyanine dyes represented by the formula (I) are well known as dyes having high green sensitivity. Furthermore, it is well known that when this dye is used in combination with an imidacarbocyanine dye, supersensitization is achieved and the spectral sensitive wavelength region is extended to a longer wavelength side. On the other hand, many of the sensitizing dyes represented by th formula (II) have a quite low spectral sensitivity. However, when they are used in combination with the oxacarbocyanine dye represented by the formula (I), they can increase the green sensistivity without substantially changing the spectral sensitivity distribution of the oxacarbocyanine dye.

That is, supersensitization can be achieved without shifting the spectral sensitive wavelength region of the oxacarbocyanine dye. Moreover, they have an advantage that residual coloring is small. Since the object can be attained by the use of the sensitizing dye of the formula (I) in a small amount of about ¼ to ⅛ of the sensitizing dye of the formula (II), residual coloring is not increased.

The supersensitization of the present invention is usable in producing an emulsion for a multi-layer color film of the incorporated-coupler type, particularly a reversal color film and a negative color film.

Representative examples of dyes of the formula (I) and (II) used in the present invention are shown below although the present invention is not to be construed as being limited thereto.

Examples of the sensitizing dyes represented by the formula (I)

(I - A)

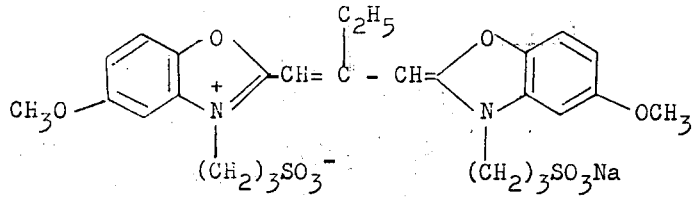

(I - B)

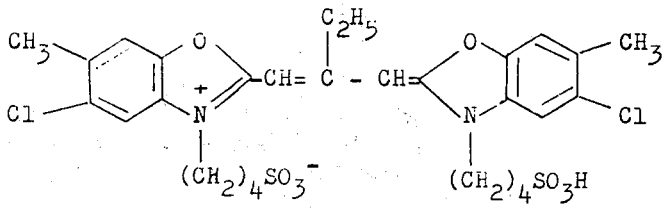

(I - C)

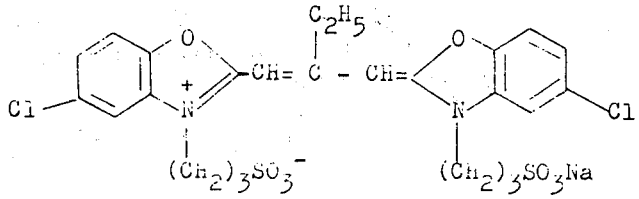

(I - D)
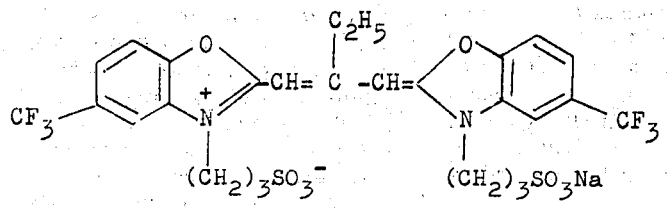
(I - E)
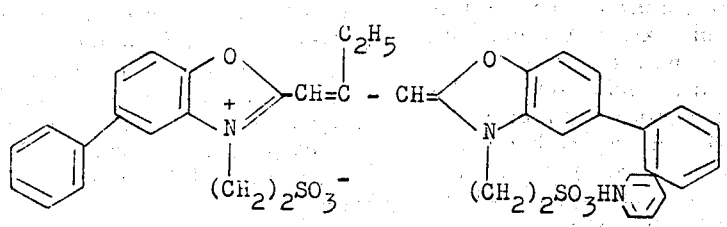
(I - F)
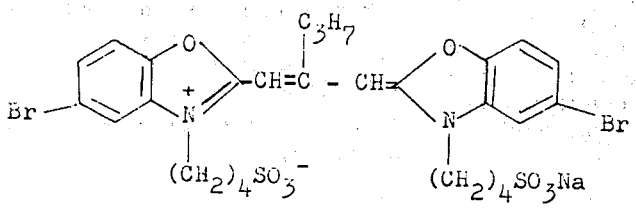
(I - G)
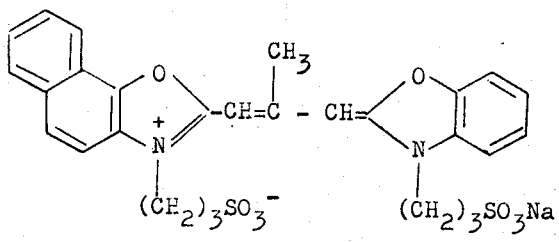
(I - H)
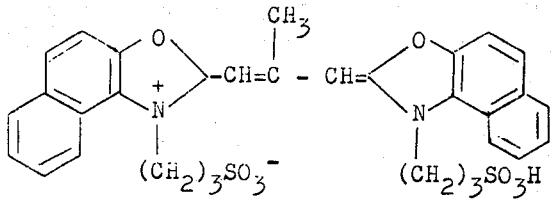
(I - I)
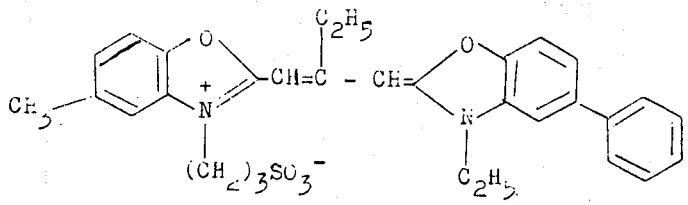

Examples of the dyes represented by the formula (II)
(II - A)
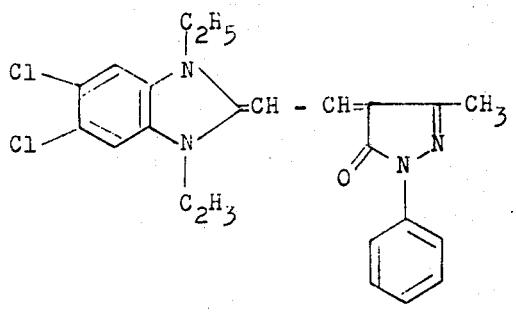
(II - B)
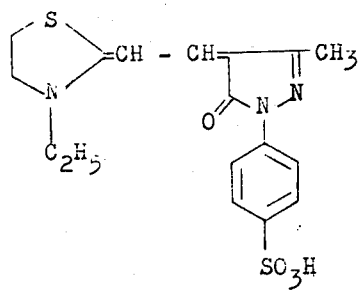
(II - C)
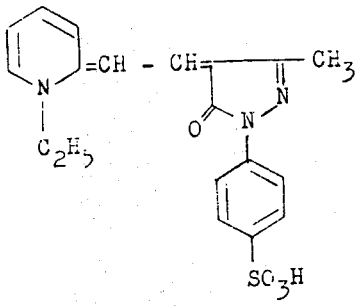
(II - D)
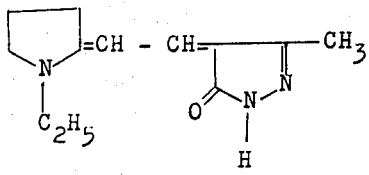
(II - E)
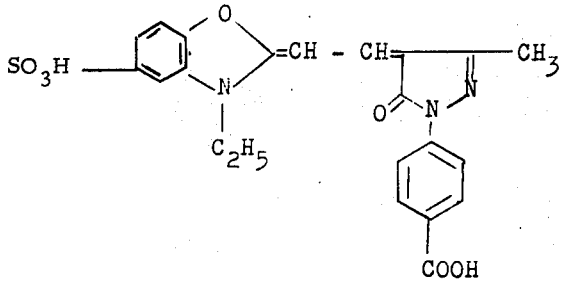
(II - F)
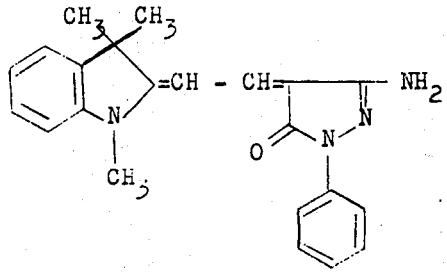
(II - G)
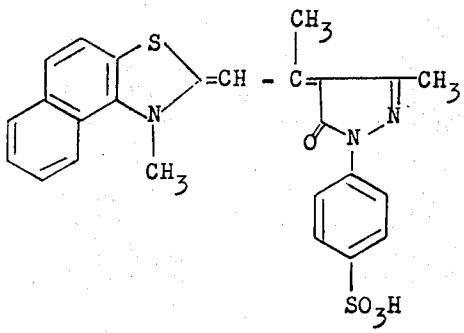
(II - H)
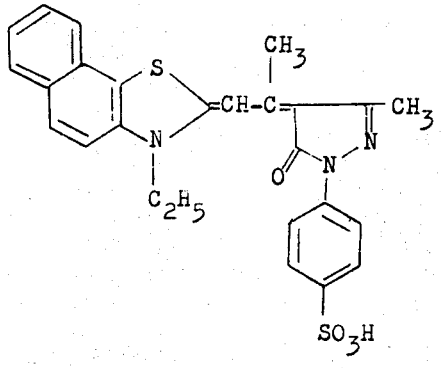
(II - I)
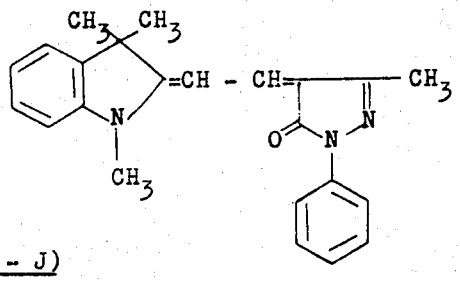
(II - J)
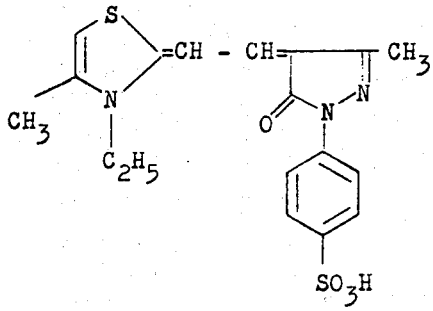

(II - K)

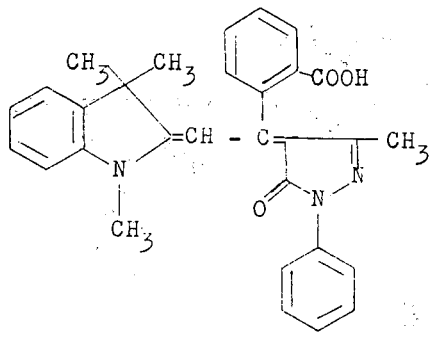

The silver halide photographic emulsions which can be used in the present invention can be produced by conventional methods and contain silver chloride, silver bromide, silver iodide or mixtures thereof which can be precipitated by the single jet process, double jet process, or a conbination of these processes. A preferred silver halide is silver iodobromide or silver chloroiodobromide. The average diameter of the grains preferably ranges from about 0.04 $\mu$ to 2 $\mu$ as measured with the projected area method or by the number average measurement.

To the silver halide photographic emulsion, conventionally used chemical sensitizations such as gold sensitization as described in U.S. Pat. Nos. 2,540,085, 2,597,856, 2,597,915, 2,399,083, etc.; sensitization using Group VIII metal ions; sulfur sensitization as described in U.S. Pat. Nos. 1,574,944, 2,278,947, 2,440,206, 2,410,689, 3,189,458, 3,415,649, etc.; reduction sensitization as described in U.S. Pat. Nos. 2,518,698, 2,419,974, 2,983,610, etc.; or a combination of the sensitization methods, can be applied.

Chemical sensitizers which can be used in the present invention include sulfur sensitizers such as allyl thiocarbamide, thiourea, sodium thiosulfate, cystine, and the like; noble metal sensitizers such as potassium chloroaurate, aurous thiosulfate, potassium chloropalladate, and the like; and reduction sensitizers such as stannous chloride, phenylhydrazine, reductone, and the like; etc. Polyoxyethylene derivatives, polyoxypropylene derivatives, quaternary ammonium group containing derivatives can be present in the emulsion.

Furthermore, antifogging agents such as nitrobenzoimidazole and ammoniumchloroplatinate, and stabilizers such as 4-hydroxy-6-methyl-1,3,3*a*,7-tetrazaindene can be present in the emulsion.

Hardening agents, e.g., aldehydes, such as glyoxal as disclosed in U.S. Pat. No. 1,870,354, glutalaldehyde as disclosed in British Pat. No. 825,544, N-methylol substituted compounds, such as N,N'-dimethylolurea, dioxane derivatives, e.g., dihydroxydioxane as disclosed in U.S. Pat. No. 3,380,829, compounds having epoxy groups, as disclosed in U.S. Pat. Nos. 3,047,394 and 3,091,537, compounds having active halogens, such as 2,4-dichloro-6-hydroxy-1,3,5-triazine as disclosed in U.S. Pat. No. 3,325,287, mucohalic acids such as mucochloric acid and mucobromic acid as disclosed in U.S. Pat. No. 2,080,019, bis-(methane sulfonic acid ester) as disclosed in U.S. Pat. No. 2,726,162, sulfonyl compounds such as bis-(benzene sulfonyl chloride) as disclosed in U.S. Pat. No. 2,725,295, aziridine compounds, divinylsulfones as disclosed in U.S. Pat. No. 2,579,871, compounds having active olefinic bonds such as divinyl ketone as disclosed in German Pat. No. 872,153, compounds having acryloyl groups as disclosed in U.S. Pat. Nos. 3,255,000 and 3,635,718, British Pat. No. 994,869 and German Pat. No. 1,090,427, alkylene bis-maleimide as disclosed in U.S. Pat. No. 2,992,109, isocyanates as disclosed in U.S. Pat. No. 3,103,437, carbodiimides as disclosed in U.S. Pat. No. 3,100,704, isooxazole derivatives as disclosed in U.S. Pat. Nos. 3,321,313 and 3,543,292, polymeric hardeners such as dialdehyde starch as disclosed in U.S. Pat. No. 3,057,723, and inorganic hardeners, such as chrom alum, chrom acetate, zirconium sulfate, etc.; can be present in the emulsion.

Surface active agents, e.g., nonionic surface active agents, such as saponin, polyethyleneglycol, polyethylene glycol/polypropylene glycol adducts as disclosed in U.S. Pat. No. 3,294,540, polyalkyleneglycol ethers, esters, and amides as disclosed in U.S. Pat. No. 2,831,766, anionic surface active agents, such as alkyl carboxylic acid salts, alkyl sulfonic acid salts, alkylbenzene sulfonic acid salts, alkylnaphthalene sulfonic acid salts, alkyl sulfates, N-acyl-N-alkyltaurine as disclosed in U.S. Pat. No. 2,739,891, maleopimalates as disclosed in U.S. Pat. Nos. 2,359,980, 2,409,930 and 2,447,750, other anionic surface active agents as disclosed in U.S. Pat. Nos. 2,823,123 and 3,415,649, amphoteric surface active agents, e.g., as disclosed in U.S. Pat. No. 3,726,683 and British Pat. No. 1,159,825, etc., can also be employed, if desired.

When the silver halide emulsion as used herein is used for a color photographic photosensitive material, a color coupler and dispersing agents therefor can be added to the silver halide emulsion. Examples of color couplers which can be employed are disclosed in the following U.S. Pats; e.g., yellow couplers as described in U.S. Pat. Nos. 3,277,155; 3,415,652; 3,447,928; 3,408,194; 2,875,057; 3,265,506; 3,409,439; 3,551,155; 3,551,156; 3,582,322, etc.; magenta couplers as described in U.S. Pat. Nos. 2,600,788; 2,983,608; 3,006,759; 3,062,653; 3,214,437; 3,253,924; 3,311,476; 3,419,391; 3,419,808; 3,476,560; 3,582,322, etc.; and cyan couplers as described in U.S. Pat. Nos. 2,474,293; 2,698,794; 3,034,892; 3,214,437; 3,253,924; 3,311,476; 3,458,315; 3,582,322; 3,591,383; etc.

Moreover, to the silver halide photographic emulsion, as a protective colloid, gelatin; gelatin derivatives, such as phthalated gelatin and malonated gelatin; cellulose derivatives such as hydroxyethyl cellulose and carboxymethyl cellulose; soluble starches such as dextrin; hydrophilic polymers, etc. are added. Suitable gelatin derivatives include those formed by the reaction of gelatin with aromatic sulfonyl chlorides, aromatic acid chlorides, aromatic acid anhydrides, isocyanates, 1,4-diketones, as disclosed in U.S. Pat. No. 2,614,928, trimellitic acid, as disclosed in U.S. Pat. No. 3,118,766, organic acids having an active halogen, as disclosed in Japanese Pat. application No. 5514/1964, aromatic glycidyl ethers as disclosed in Japanese Pat. application No. 26845/1967, maleimides, maleamic acid, unsaturated aliphatic diamides as disclosed in U.S. Pat. No. 3,186,846, sulfoalkylated gelatin as disclosed in British Pat. No. 1,033,189, polyoxyalkylene derivatives as disclosed in U.S. Pat. No. 3,312,553 and polymer-grafted gelatins, e.g., grafted with acrylic acid, methacrylic acid, acrylate esters, methacrylate esters, acrylamide, acrylonitrile, styrene, etc. Specific examples of synthetic hydrophilic polymers include homopolymers or copolymers of vinylalcohol, N-vinylpyrrolidone, hydroxyalkylmethacrylate, methacrylamide, N-substituted methacrylamide, styrene sulfonic acid, etc., copolymers of these monomers with methacrylic esters, vinyl acetate, styrene, etc., and a monomer as described previously copolymerized with maleic anhydride, maleic acid, etc. Plasticizers for dimensional stability; latex polymers; and matting agents can also be added.

The thus finished emulsion is coated on a suitable support, such as a baryta paper, a resin coated paper, a synthetic paper, a cellulose triacetate film, a polyethylene terephthalate film, a glass plate, or other plastic base. A suitable coating amount is generally about 0.001 to 0.1 mol (as silver) 1 $m^2$ of the support.

The sensitizing dyes as used herein can be added as a solution in water or organic solvents miscible with water such as methanol, ethanol, methyl cellosolve, pyridine, and the like. The sensitizing dye is used in an amount conventionally used to effect supersensitization, for example, in an amount of about $5\times 10^{-3}$ to $1 \times 10^{-6}$ mole per mole of silver. The molar ratio of the dye of the formula (II) to the dye of the formula (I) preferably ranges from about 2:1 to 20:1.

The combination of the dyes of the present invention can be used in sensitizing various silver halide photographic emulsions for color, and black and white photosensitive materials.

Emulsions which can be used in the present invention are an emulsion for color positive materials, an emulsion for color papers, an emulsion for color negative materials, an emulsion for color reversal (in which a coupler is incorporated or not incorporated), an emulsion for use in photographic photosensitive materials for plate making such as a lith film, an emulsion for use in a photosensitive material for recording a cathode ray tube display, an emulsion for use in a photosensitive material for X-ray recording, particularly direct and indirect photographic material using a screen, an emulsion for use in a colloid transfer process as described in U.S. Pat. No. 2,716,059, an emulsion for use in the silver salt diffusion transfer process as described in U.S. Pat. Nos. 2,352,014, 2,543,181, 3,020,155, 2,861,885, etc., an emulsion for use in the color diffusion transfer process as described in U.S. Pat. Nos. 3,087,816, 3,185,567, 2,983,606, 3,253,915, 3,227,550, 3,227,551, 3,227,552, 3,415,644, 3,415,645, 3,415,646, etc., an emulsion for use in the inhibition transfer process as described in U.S. Pat. No. 2,882,156, an emulsion for use in the silver dye bleaching process as described in Friedman, History of Color Photography, American Photographic Publishers Co., (1944), particularly Chapter 24 and British Journal of Photography, Vol. 111, pages 308 to 309, Apr. 7 (1964), an emulsion for use in a material for recording a print-out image as described in U.S. Pat. No. 2,369,449 and Belgian Pat. No. 704,255, an emulsion for use in a direct print image as described in U.S. Pat. Nos. 3,033,682 and 3,287,137, an emulsion for use in a thermally developable photosensitive material as described in U.S. Pat. Nos. 3,152,904, 3,312,550, 3,148,122 and British Pat. No. 1,110,046, and an emulsion for use in a photosensitive material for physical development as described in British Pat. Nos. 920,277 and 1,131,238, etc.

The dyes as used herein are used for spectral sensitization in accordance to the methods as described in German Pat. Laid-open No. 2,104,283 and U.S. Pat. No. 3,649,286.

The invention is further explained in greater detail by reference to the following examples. Unless otherwise indicated, all parts, percents, ratios and the like are by weight.

EXAMPLE 1

Silver halide grains were precipitated by the double jet process and subjected to a conventional physical ripening, a desalting treatment, and a chemical ripening. Thus, a silver iodide bromide emulsion (iodine content: 7 mole %) was obtained.

The average diameter of the silver halide grains contained in the emulsion was 0.42 $\mu$.

0.52 mole of the silver halide was contained in 1 Kg of the emulsion.

1 Kg of the emulsion was charged in a pot and melted by immersing the pot into a thermostatic bath at 50°C.

Methanol solutions of sensitizing dyes of the present invention and sensitizing dyes for comparison were added to the emulsion in amounts as indicated in Table 1 and mixed at 40°C. Moreover, 10 ml of a 0.1% by weight aqueous solution of 4-hydroxy-6-methyl-1,3,3*a*,7-tetrazaindene, 10 ml of a 1% by weight aqueous solution of sodium 1-hydroxy-3,5-dichlorotriazine, and 10 ml of a 1% by weight aqueous solution of sodium dodecylbenzene sulfonate were added and mixed.

The thus finished emulsion was coated on a cellulose triacetate film base in a dry thickness of 5 microns and dried. Thus, a sample of a photosensitive material was obtained. The sample was slit into strips.

One piece was wedgewise exposed to a light source having a color temperature of 5400°K equipped with a blue filter (Wratten 47B, produced by Eastman Kodak Co.) and yellow filter (SC-50, produced by the Fuji Photo Film Co., Ltd.). Another piece was exposed to obtain a spectrogram thereof by the use of a diffraction grating type of spectrophotometer equipped with a tungsten light source of a color temperature 2666°K.

These strips were developed with a developer having the following composition at 20°C for 20 minutes, stopped, fixed, and washed. Thus, strips having a given image were obtained.

Density measurement using an S type densitometer produced by the Fuji Photo Film Co., Ltd., was measured and the sensitivity of blue color filter (SB), the sensitivity of yellow color filter (SY), and fog were obtained. The base point of the optical density for measuring the sensitivity was at a point of (fog+0.20).

| Composition of Developer | |
|---|---|
| Water | 500 ml |
| Metol | 2 g |
| Sodium Sulfite (anhydrous) | 90 g |
| Hydroquinone | 8 g |
| Sodium Carbonate (monohydrate) | 52.5 g |
| Potassium Bromide | 5 g |
| Water to make up | 1 liter |

The results obtained are shown in Table 1 as a relative value. Tests Nos. 7 and 8 were carried out for comparison.

Figure 2:
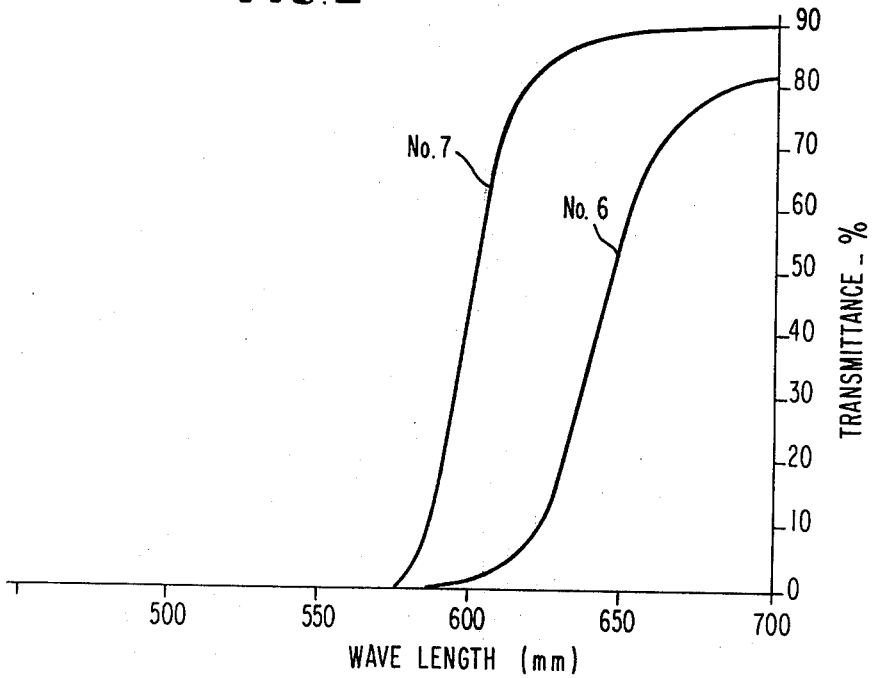
FIG. 2 shows the spectral transmission curves, wherein No. 6 and No. 7 indicate the spectral transmission curves of safe light filters No. 6 and No. 7, produced by Fuji Photo Film Co., Ltd. for obtaining safe lights which are commonly used in a dark room for the development of a lithortho film and an indirect X-ray photographic film, respectively.
Figure 3:
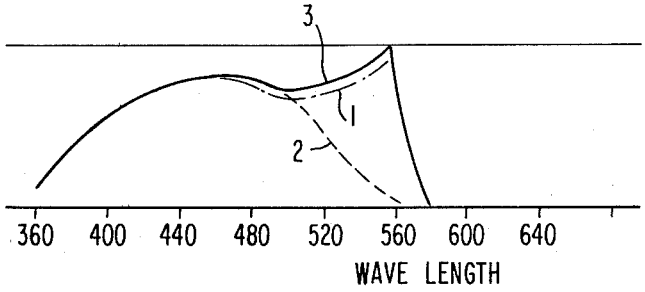
FIGS. 3 to 5 show the spectral sensitization curves of photographic emulsions, wherein FIGS. 3 and 4 indicate the spectral sensitization curves of the emulsions of the present invention, and FIG. 5 indicates those of dyes for comparison.
Figure 4:
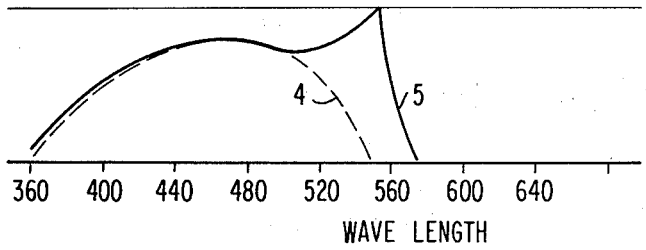
Figure 5:
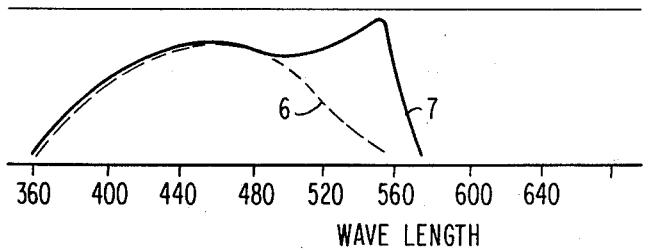

Table 1
| No. | Sensitizing Dyes and Amount thereof | | | | | SY (relative value) | SB (relative value) | fog | Spectrogram |
|---|---|---|---|---|---|---|---|---|---|
| 1 | | — | | — | — | 13 | 100 (base point) | 0.05 | |
| | (I-A) | 8 | | — | — | 61 | 80 | 0.05 | |
| | | 16 | | — | — | 100 (base point) | 70 | 0.05 | |
| | | 32 | | — | — | 104 | 63 | 0.07 | |
| | | — | (II-C) | 1 | — | 13 | 86 | 0.05 | |
| | | — | | 2 | — | 13 | 81 | 0.05 | |
| | | — | | 4 | — | 12 | 77 | 0.05 | |
| | (I-A) | 16 | (II-C) | 2 | — | 110 | 77 | 0.05 | |
| | | 16 | | 4 | — | 114 | 77 | 0.05 | |
| 2 | (I-C) | 8 | | — | — | 83 | 91 | 0.05 | |
| | | 16 | | — | — | 100 | 83 | 0.05 | FIG. 3-1 |
| | | 32 | | — | — | 100 | 70 | 0.06 | |
| | | — | (II-G) | 2 | — | 15 | 83 | 0.05 | FIG. 3-2 |
| | | — | | 4 | — | 18 | 73 | 0.05 | |
| | | — | | 8 | — | 22 | 73 | 0.06 | |
| | (I-C) | 16 | (II-G) | 2 | — | 142 | 91 | 0.05 | FIG. 3-3 |
| | | 16 | | 4 | — | 130 | 91 | 0.05 | |
| 3 | | — | (II-A) | 1 | — | 13 | 96 | 0.05 | |
| | | — | | 2 | — | 13 | 91 | 0.05 | FIG. 4-4 |
| | | — | | 4 | — | 13 | 67 | 0.05 | |
| | (I-C) | 16 | (II-A) | 1 | — | 142 | 83 | 0.05 | |
| | | 16 | | 2 | — | 142 | 83 | 0.05 | FIG. 4-5 |
| 4 | | — | (II-B) | 2 | — | 13 | 97 | 0.05 | |
| | | — | | 4 | — | 13 | 97 | 0.05 | |
| | | | | 8 | — | 13 | 97 | 0.05 | |
| | (I-A) | 16 | (II-B) | 2 | — | 133 | 97 | 0.05 | |
| | | 16 | | 4 | — | 129 | 83 | 0.05 | |
| 5 | (I-E) | 4 | | — | — | 71 | 100 | 0.06 | |
| | | 8 | | — | — | 125 | 100 | 0.07 | |
| | | 16 | | — | — | 100 | 64 | 0.12 | |
| | (I-E) | 4 | (II-G) | 1 | — | 88 | 97 | 0.06 | |
| | | 4 | | 2 | — | 100 | 97 | 0.06 | |
| | (I-E) | 8 | (II-G) | 1 | — | 140 | 97 | 0.07 | |
| | | 8 | | 2 | — | 145 | 97 | 0.07 | |
| 6 | (I-F) | 8 | | — | — | 49 | 75 | 0.05 | |
| | | 16 | | — | — | 59 | 65 | 0.05 | |
| | | 32 | | — | — | 63 | 50 | 0.06 | |
| | (I-F) | 16 | (II-C) | 2 | — | 102 | 70 | 0.05 | |
| | | 16 | | 4 | — | 102 | 70 | 0.05 | |
| 7 | | — | — | (A)* | 2 | 13 | 90 | 0.05 | FIG. 5-6 |
| | | — | — | | 4 | 13 | 68 | 0.05 | |
| | | — | — | | 8 | 13 | 68 | 0.05 | |
| | (I-C) | 16 | — | (A) | 2 | 100 | 90 | 0.05 | FIG. 5-7 |
| | | 16 | — | | 4 | 81 | 84 | 0.05 | |
| 8 | | — | — | (B)** | 2 | 24 | 84 | 0.05 | |
| | | — | — | | 4 | 24 | 71 | 0.05 | |
| | | — | — | | 8 | 19 | 41 | 0.05 | |
| | (I-E) | 16 | — | (B) | 2 | 96 | 74 | 0.08 | |
| | | 16 | — | | 4 | 52 | 62 | 0.08 | |
* Dye (A)
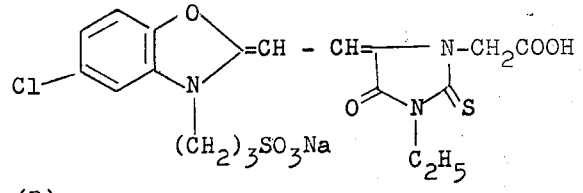
** Dye (B)
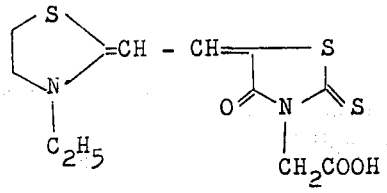

It can be seen from the results obtained that the combination of the dyes of the present invention is effective to achieve supersensitization. Even though they are used in combination with well known green sensitive sensitizing dyes such 2,2'-thiocyanine, imidacarbocyanine, and the like, the effect of the present invention is not deteriorated.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion having high green sensitivity containing in supersensitizing amounts the combination of 1. at least one sensitizing dye represented by the formula (I)

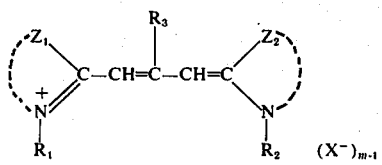

(I)

wherein $Z_1$ and $Z_2$ are the atomic groups necessary for forming a benzoxazole ring or a naphthoxazole ring, in which a benzene nucleus of the ring may be substituted; $R_1$ and $R_2$ are aliphatic groups and at least one of $R_1$ and $R_2$ is a carboxyalkyl group or a sulfoalkyl group; $R_3$ is a hydrogen atom or an alkyl group; X is an acid anion; and m is 1 or 2 and m is 1 when the dye forms an intramolecular betaine like salt, and 2. at least one sensitizing dye represented by the formula (II)

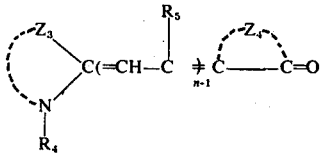

(II)

wherein $Z_3$ is an atomic group necessary for forming a 5-membered or 6-membered heterocyclic ring selected from the group consisting of a pyridine ring, a quinoline ring, an oxazoline ring, an oxazole ring, a thiazoline ring, a thiazole ring, a selenazole ring, a benzoxazole ring, a benzothiazole ring, a benzoselenazole ring, a benzimidazole ring, a dialkylindolenine ring, a α-naphthoxazole ring, a β-naphthoxazole ring, a β,β-naphthoxazole ring, a α-naphthothiazole ring, a β-naphthothiazole ring, a β,β-naphthothiazole ring, a α-naphthoselenazole ring, a tetrazole ring and a pyrroline ring, which may be substituted with one or more of a halogen atom, an alkyl group, an alkoxy group, an alkoxycarbonyl group, and an aryl group as described for $Z_1$ and $Z_2$ in addition to $R_4$; $Z_4$ is an atomic group necessary for forming a 2-pyrazoline-5-one ring nucleus which may be substituted with a member selected from the group consisting of an alkyl group, an alkoxy group, an alkoxycarbonyl group, an aryl group, an alkoxyalkyl group, an N-(N,N-dialkylaminoalkyl)carbamoylalkyl group, an N-(N,N,N-trialkylammoniumalkyl)carbamoylalkyl group, an N,N,N-trialkylammoniumalkyl group, a hydroxyalkyl group, a carboxyalkyl group, a sulfoalkyl group, and an amino group; $R_4$ is an aliphatic group; $R_5$ is a hydrogen atom, an alkyl group, or an aryl group; and *n* is 1 or 2.

2. The silver halide photographic emulsion according to claim 1, wherein the ring formed by $Z_1$ or $Z_2$ is a benzoxazole ring substituted with a chlorine atom, a bromine atom, a phenyl group, or a methoxy group at 5-position thereof; $R_1$ and $R_2$ each is a sulfoalkyl group or a carboxyalkyl group; and $R_3$ is an ethyl group.

3. The silver halide photographic emulsion according to claim 1, wherein the heterocyclic ring formed by $Z_3$ is a benzoxazole ring, a thiazoline ring, a benzothiazole ring, a β-naphthothiazole ring, an α-naphthothiazole ring, a benzimidazole ring, a pyrrole ring, or a dimethylindolenine ring.

4. The silver halide photographic emulsion according to claim 1, wherein $R_4$ is a sulfoalkyl group.

5. The silver halide photographic emulsion according to claim 1, wherein $R_5$ is a methyl group, an ethyl group, or a phenyl group.

6. The silver halide photographic emulsion according to claim 1, wherein the hetero ring formed by $Z_4$ is a pyrazoline-5-one ring substituted with a carboxyphenyl group or a sulfophenyl group.

7. The silver halide photographic emulsion according to claim 1, wherein the dye represented by the formula (I) contains at least one 5-position chlorine substituted benzoxazole nucleus as the nitrogen containing heterocyclic ring.

* * * * *